US005115417A

United States Patent [19]

Saunders

[11] Patent Number: 5,115,417

[45] Date of Patent: May 19, 1992

[54] TIDE CALCULATING AND DISPLAY DEVICE

[76] Inventor: Alan J. Saunders, P.O. Box 336, Danforth Ln., Califon, N.J. 07830

[21] Appl. No.: 316,986

[22] Filed: Feb. 28, 1989

[51] Int. Cl.[5] ..... G04B 19/26

[52] U.S. Cl. ..... 368/19

[58] Field of Search ..... 368/10,14,15,19,20

[56] References Cited

U.S. PATENT DOCUMENTS

| | | | |
|---|---|---|---|
| 2,677,928 | 5/1954 | Haynes | 368/19 |
| 4,035,617 | 6/1977 | Banner | 368/19 |
| 4,412,749 | 12/1983 | Showalter | 368/19 |
| 4,585,927 | 4/1986 | Thompson | 235/70 R |
| 4,623,259 | 11/1986 | Oberst | 368/19 |
| 4,849,949 | 7/1989 | Voth | 368/19 |

FOREIGN PATENT DOCUMENTS

| | | | |
|---|---|---|---|
| 60-171479 | 9/1985 | Japan | 368/19 |
| 60-171480 | 9/1985 | Japan | 368/19 |
| 60-250286 | 12/1985 | Japan | 368/19 |

*Primary Examiner*—Vit W. Miska

[57] ABSTRACT

A watch or other instrument for graphically displaying tide and time conditions and for determining tide conditions for a date and time in the future. Conventional watch functions (21) are combined with computing circuitry (FIG. 2) to continuously update and show tide conditions by means of tide height bar (29), and tide direction indicators (22, 22). Future tides are indicated on the same display when the Future Tide mode (33B) is selected thru buttons (5, 6, 7) and the selected date and time is entered.

29 Claims, 4 Drawing Sheets

TIDE CALCULATING AND DISPLAY DEVICE

BACKGROUND-FIELD OF INVENTION

This invention relates to the display and prediction of tides and in particular to a device that continuously indicates the existing level of tide; whether it is rising or falling; and the prediction of future tides for any day in the future, using electronic means and visually graphic displays.

Tide states are of interest to boaters, sailors, fishermen surfers, shellers and coastal residents since the tides influence their activities. While there are over 40 celestial bodies that affect the tides, the moon has the dominant influence by a factor of approximately three times any other body. Tides are produced as a result of the moon's gravitational forces on Earth's waters, and occur approximately twice per calendar day, since the gravitational effect occurs on both sides of the Earth, diametrically opposed. The lunar cycle is 24 hours; 50 minutes; 28.33 seconds. The tide has two highs and two lows during each cycle. The other celestial effects can change the tides by over one hour, but over a period of time it averages out to the lunar cycle. Therefore each high tide occurs 12 hours; 25 minutes; 14.16 seconds after the previous high tide; and likewise for the low tides, when considered over any period of time.

If a conventional watch time hand rotates 360 degrees in 12:00:00 hours a tide indicator would rotate faster by the factors given above. The ratio of real time to lunar (tide) time is accordingly 1.03505. It is this fixed and unvarying ratio that is used in this invention to predict and calculate tide conditions.

BACKGROUND-DESCRIPTION OF PRIOR ART

Prior art has used these laws of physics to produce various tide indicating devices.

Tide clocks are available that have a rotary sweep hand that advances faster than real time by the factors given above . They are limited to displaying only the existing state of the tides, and the rotating sweep hand does not represent very clearly the actual tide conditions, since water levels rise and fall.

Mechanical wrist watches have been available and have been patented, (U.S. Pat. No. 2,677,928 to Haynes, 1954)) that use circular tide indicating rings, bezels, or discs to represent the tide conditions. For those watches that have only a settable tide ring, they must be reset every tide cycle to remain reasonably accurate; and they cannot predict future tides. Again, visual representation of tides using rotating elements is inadequate.

A wrist watch using circular discs to indicate tide conditions is in the prior art (U.S. Pat. No. 4,035,617 to Banner, 1977) which uses rotatable discs to display the existing tide conditions and mechanically advances the tide conditions so that it does not have to be reset regularly. Compared to a tide clock it offers only the advantage that days and dates are displayed in conjunction with the tide conditions. There is no ability to predict future tides; and again an inadequate representation of rising or falling tides is presented since a rotating element is used.

Another prior invention, U.S. Pat. No. 4,412,749 (to Showalter, 1983) relates to an electronic timing device that only indicates when the next high or low tide is to occur, without giving the tide conditions for the present time; and with no ability to predict or display future tides. It requires that every eighth tide have a correction factor, thereby introducing accumulative error during the seven tides preceding the correction.

OBJECTS AND ADVANTAGES

It is one object of this invention to provide a tide indicating device in conjunction with an electronic display of existing tide conditions whereby the electronic display gives a clear indication of tide conditions by representing the rise and fall of the tides.

It is another object of this invention to provide a device that can determine future tide conditions in conjunction with an electronic display which will allow the user to easily determine the tide conditions for any future date.

It is another object of this invention to combine the graphical electronic display with conventional watch functions to provide a watch that indicates graphically existing tide conditions and can predict future tide conditions.

Another object of this invention is to incorporate time and tide functions in a portable instrument that can be used to display time and tide conditions using the graphical electronic display and other related functions such as currents, moon phases, and time.

Still another object of this invention is to provide a home or office time and tide indicator using the electronic means and graphical displays as divulged herein.

Other objects and advantages will be apparent from the description, and it will be understood that changes in the structure, or in combinations of the elements herein may be made without departing from the spirit and intent of this invention.

The watch functions referred to herein are commonly available and are not a part of this invention and not in the claims.

DRAWINGS AND FIGURES

DESCRIPTION

Figure 1:
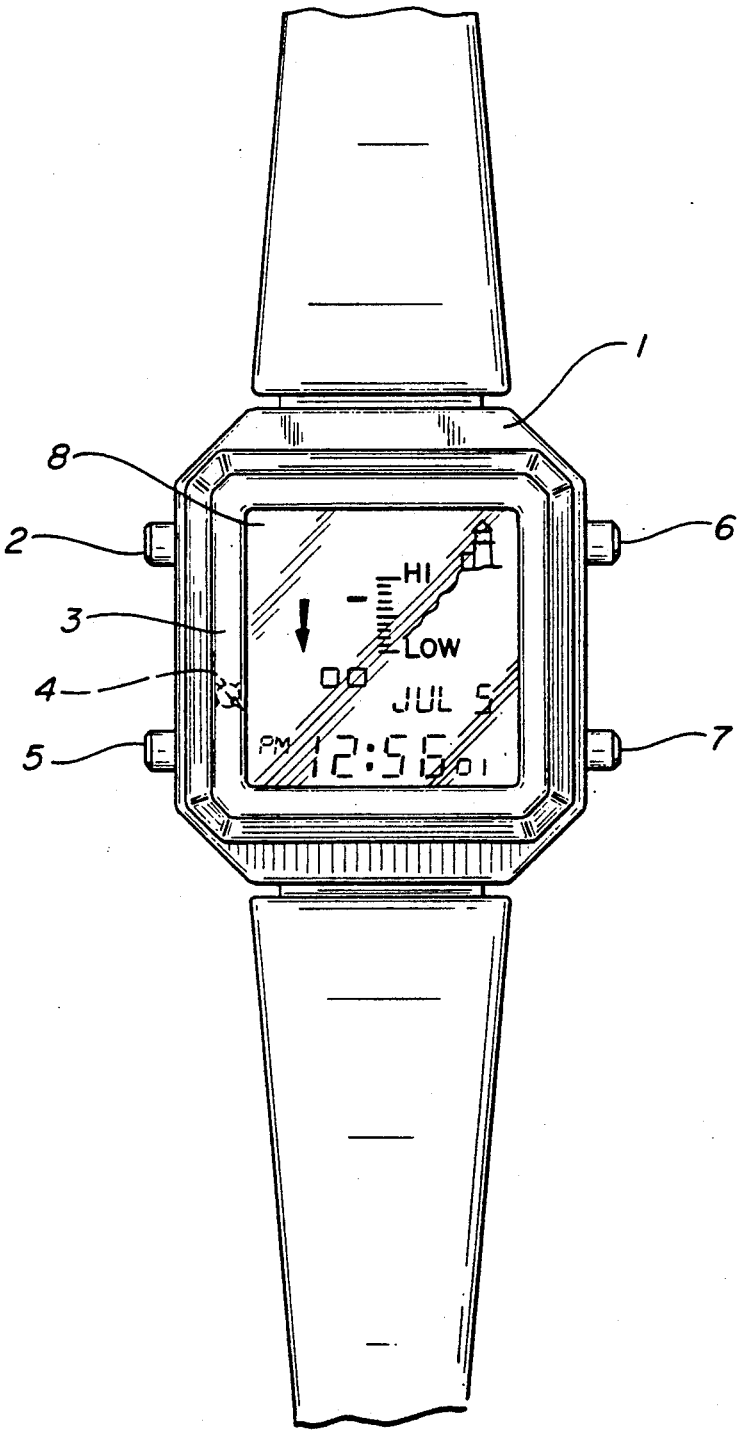
FIG. 1 is a front view of a preferred embodiment of the invention which indicates an arrangement of watch functions and tide functions, as described herein.

The watch of FIG. 1 (Arrangement of Watch and Tide Functions) shows a case 1 containing all of the elements required for the operation of the invention. A light button 2 can be depressed for night or low light conditions, which will illuminate the front face lens 3 by means of a bulb or light producing element 4. Certain graphical or decorative information can be permanently printed on the face to aid in the representation of functions. A mode button 5 is used to choose the desired operating mode, such as normal time or future tide. A select button 6 is used when setting the watch or initial tide conditions. An advance button 7 advances the function such as hour; minute; day; etc. during the setting operation. The liquid crystal display (LCD) 8, which is underneath and protected by the lens 3, has both permanently fixed printed figures; and variable segments which are electrically activated by the program and combined to form the display. The unique elements of the display will be discussed in FIG. 3; (Display).

Figure 2:
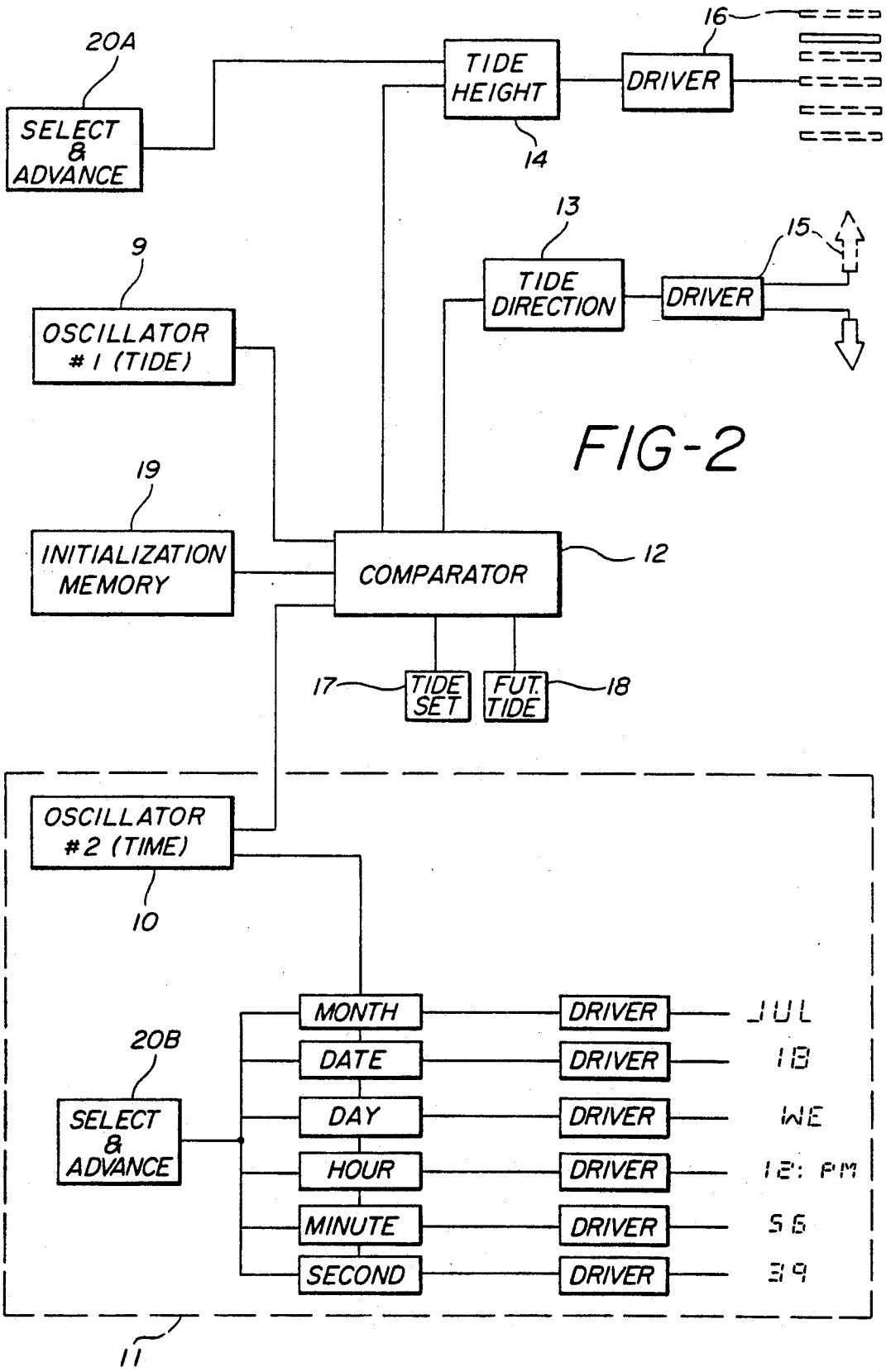
FIG. 2 is a block diagram of the electronics of the time and tide indicating device.

FIG. 2 (Block Diagram of The Electronic Circuit) shows Tide Oscillator 9, which is set to run at a faster rate than Time Oscillator 10, by the factor of 1.03505, which is the ratio of lunar cycle to calendar cycle. Accordingly, for every 12 hrs; 00 minutes; 00 seconds that the time oscillator 10 advances, the tide oscillator 9 advances by 12 hours; 25 minutes; 14.16 seconds. Within the dotted lines is shown conventional digital watch circuitry 11, which is available in many forms and commonly found in watches of all price ranges. Other circuitry may be included such as alarms or timers, but are omitted here for the sake of clarity, and because no invention is claimed in regards to the conventional circuitry 11. Comparator 12 continuously compares the output of Tide Oscillator 9 with the output of Time Oscillator 10. The difference is used to drive the tide direction indicator circuit 13; and the tide height indicator circuit 14. These circuits in turn drive the LCD display elements indicating direction 15, and height 16. Tide Set function 17 is used to initialize the tide height at a given time. Future Tide function 18 is used to predict the future tides by comparing calendar and time information for the selected future day and time with the tide oscillator 9 input. Initialization memory circuit 19 is used to establish the starting relationship of tide and time and is set by the user for any local tide condition corresponding to the appropriate time. Any tide condition can be used to set the initial conditions, but in the preferred embodiment of the invention high tides are used since they are commonly available in reference tables published by many sources. The select and advance functions 2OA and 2OB are used to set the tide conditions and normal watch functions during initialization.

Figure 3:
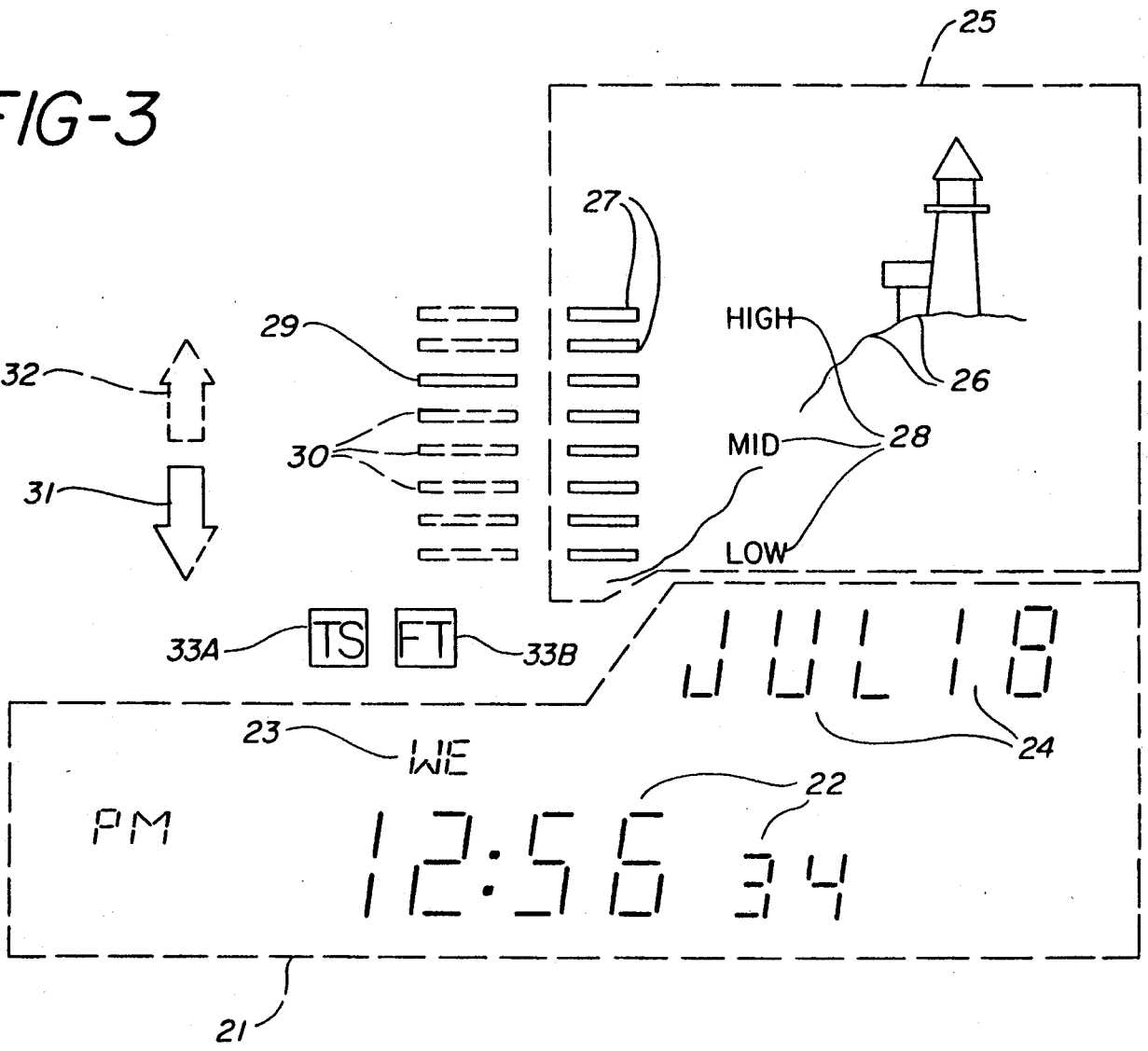
FIG. 3 is a more detailed front view of the tide indicating graphic display in the preferred embodiment.

FIG. 3, Display, shows major elements of the preferred embodiment of the invention. Within one set of dotted lines is a conventional watch display 21, commonly available in many layouts and formats. Time 22, day 23, and date 24 are all electrically changeable and driven by the time oscillator 10, of FIG. 2. Graphic symbols 25 are permanently printed to provide a visual reference of tide height conditions. The lighthouse and cliff 26 are provided to give aid in the visualization of the tide height. The tide height reference bars 27 are also provided to aid in the visualization of the tide height; as are the HIGH MID LOW letters 28. Tide height indicator bar 29 is electrically changeable to other positions as shown by dotted lines 30, and are driven by the tide height circuit 14 of FIG. 2. Tide direction indicator 31 is electrically changeable and driven by tide direction circuit 13 of FIG. 2. The alternate tide direction indicator 32 is displayed to indicate rising tide conditions and is also driven by circuit 13 of FIG. 2. Mode indicators 33A and 33B are displayed during the time and tide set mode (33A); and during the future tide mode (33B).

Figure 4:
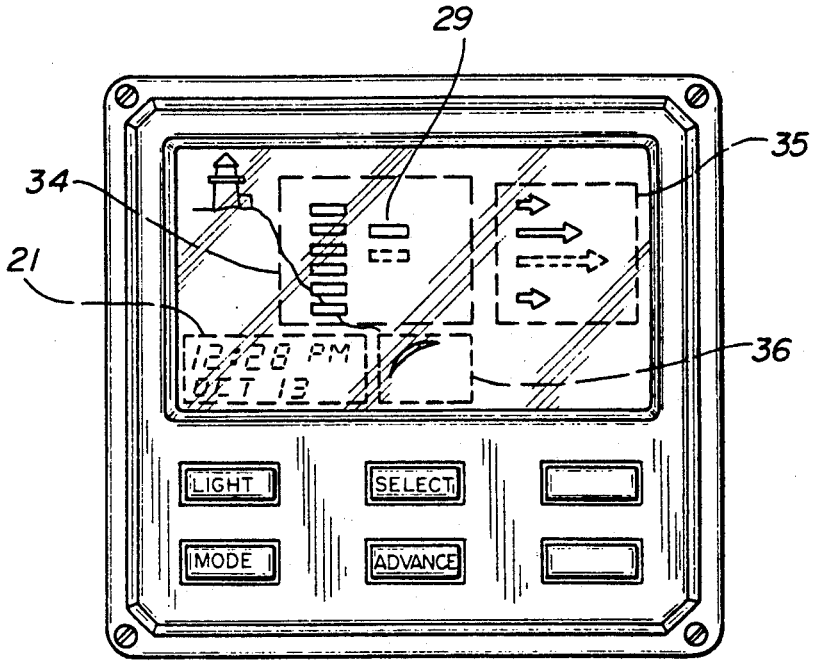
FIG. 4 is an alternate embodiment of the invention.

FIG. 4, Panel Instrument, shows an alternative embodiment of the invention for use on boats or where a larger or non-portable tide and time indicating device may be preferred. The conventional time display 21 is similar to the watch described herein as is the tide display 34. Current velocity indicator 35 is an electrically driven display that uses the same driver circuit of FIG. 3 as the tide height indicator 29. The current velocity indicator 35 varies with tide height since currents are small to non existent at high and low tides; and at maximum velocity at or near mid tide, thereby allowing arrows of varying lengths to represent currents. Moon phases 36 may be included for convenient reference and a knowledgeable user can factor the effects of the moon on tides and currents. (Maximum tidal effects occur around the times of the new moon and no moon.)

Figure 5:
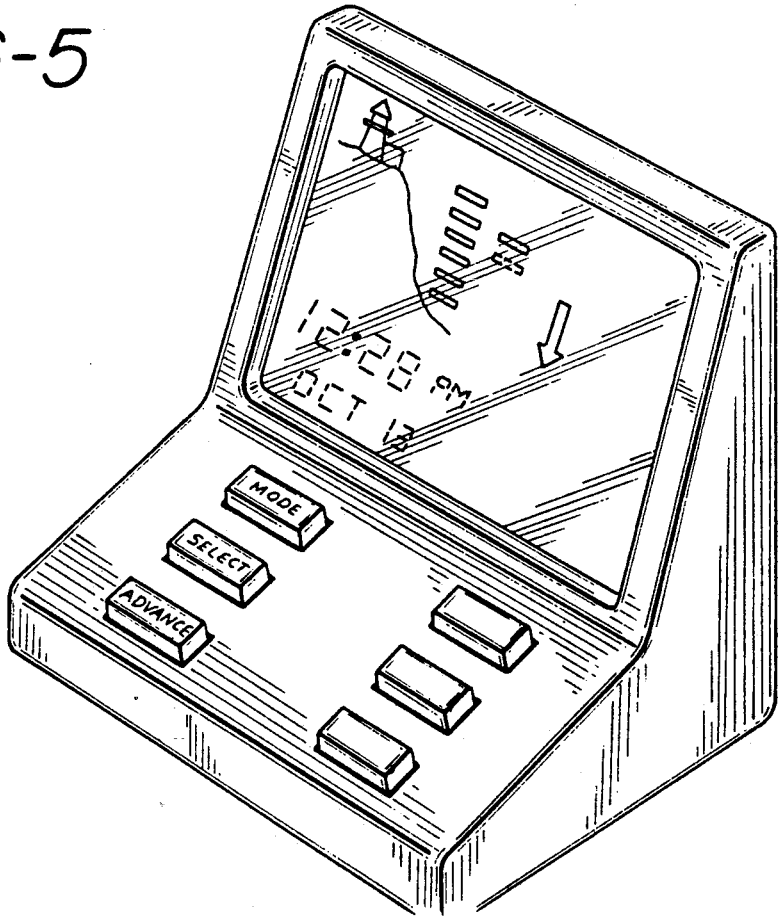
FIG. 5 is another alternate embodiment of the invention.

FIG. 5, Desk Instrument, shows an alternate embodiment of the invention to be used as a desk instrument; or in a slightly different arrangement, as a wall hung instrument.

Operation FIGS. 1, 2, 3

The manner of using the invention includes setting the initial tide and time; normal time and tide; and future tide.

In setting the initial tide, a reference table is used to choose a high tide and noting its date and time. Depressing mode button 5 of FIG. 1 causes time and tide set indicator, 33A, FIG. 3 to display. The date and hour of the high tide is entered by depressing the select button 6, and the advance button 7, both shown in FIG. 1. The tide height indicator bar 29 of FIG. 3 will be at its high position and the memory circuit 19 of FIG. 2 will store the initial high tide date and time. The time is likewise set by using the select button 6, and the advance button 7, to set all conventional watch functions , 11 of FIG. 2. Depressing the mode button 5 of FIG. 1 enters the time information into memory 19 of FIG. 2 and sets the instrument into normal time.

During normal time, the conventional watch functions 11 of FIG. 2 advance automatically and the display 21 FIG. 3 changes to indicate those functions. Also during normal time, the tide height indicator bar 29 of FIG. 3 advances automatically to the computed tide height as directed by the tide height circuit 14 of FIG. 2. As the tide height indicator 29 of FIG. 3 reaches its highest or lowest condition, the tide direction indicators, 31 or 32 of FIG. 3. display the appropriate tide direction respectively, as computed by tide direction circuit 13 of FIG. 2. The time and tide conditions are continuously displayed and updated with no interaction required from the user.

To determine future tide conditions, the mode button 5 of FIG. 1 is depressed twice which causes future tide mode indicator 33B of FIG. 3 to display. By using the select button 6, and the advance button 7, both of FIG. 1, the date and time of the desired future tide is entered. The tide height 29, and tide direction 31 or 32 of FIG. 3 then indicate the tide conditions for the selected time and date. If left in Future Tide mode the display will continuously update the tide conditions for that date.

SUMMARY, RAMIFICATIONS AND SCOPE

Accordingly, the reader will see that the tide calculating and display device of this invention can be used to easily and conveniently determine tide conditions with the following unique advantages in that Tide conditions are graphically displayed.

Tide conditions are continuously updated.

Tide conditions are represented graphically in a clearer format than prior art.

Future tide conditions are easily determined.

The basic device is incorporated in an extremely convenient wrist watch for maximum portability and utility.

The device can be incorporated in other useful embodiments such as a panel instrument, a desk display, or a wall display.

Although the description given contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. A tide prediction device for receiving known tide condition inputs and producing predicted tide condition readings therefrom comprising:

a. future tide prediction means for receiving a known tide height input corresponding to a known time input, for receiving a selected time output when a prediction of tide height is desired, and for determining a predicted tide height reading corresponding to the selected time input; and b. target height output means for generating the predicted tide height reading.

2. Tide prediction device as claimed in claim 1, wherein said tide height output means comprises at least one tide height indicator light to display the predicted tide height reading.

3. Tide prediction device as claimed in claim 1, wherein said tide height output means is a liquid crystal display (LCD).

4. Tide prediction device as claimed in claim 1, wherein said tide height prediction means measures actual time according to a calendar year; and the tide height prediction means receives an actual time signal as the selected time input and determines the predicted tide height reading corresponding to the actual time.

5. Tide prediction device as claimed in claim 1, wherein said tide height prediction means has memory means for storing inputs.

6. Tide prediction device as claimed in claim 1, wherein said device further comprises time display means for displaying the selected time input.

7. Tide prediction device as claimed in claim 1, wherein said device further comprises:

a mode button to choose the desired operating mode, such as an actual time mode or a selected time mode;

a select button to set an actual time or to input previously measured tide condition inputs; and an advance button to advance the functions such as month, day, hours, and minutes.

8. Tide prediction device as claimed in claim 1, wherein said device is a programmable wristwatch to display present or future tide height readings.

9. Tide prediction device for receiving previously measured tide condition inputs and for displaying predicted tide condition readings comprising:

a) time keeping means for measuring actual time;

b) tide condition input means for receiving a known tide height input corresponding to a known time input, and for receiving a selected time input when a prediction of a tide height is desired;

c) tide height prediction means for receiving the known tide height input, the known time input and the actual time, and for determining a predicted tide height reading corresponding to the selected time input; and d) tide height display means having at least one tide height indicator light for displaying the predicted tide height reading.

10. A tide prediction device as claimed in claim 9, wherein said tide height display means is a liquid crystal display (LCD).

11. A tide prediction device as claimed in claim 9, wherein said time keeping means comprises oscillator means having a given frequency.

12. A tide prediction device as claimed in claim 9, wherein said tide condition input means has memory means for storing inputs.

13. A tide prediction device as claimed in claim 9 wherein said selected time input is an actual time signal from the time keeping means and said prediction of tide height corresponds to said actual time signal; and said display means also displays the actual time.

14. A tide prediction device as claimed in claim 9, wherein said device further comprises:

a mode button to choose the desired operating mode, such as an actual time mode or a selected time mode;

a select button to set the actual time or to input previously measured tide conditions inputs; and an advance button to advance the functions such as month, day, hours, and minutes.

15. Tide prediction as claimed in claim 9, wherein said device is a programmable wristwatch to display present or future tide height readings.

16. Tide prediction device for receiving previously measured tide condition inputs and displaying predicted tide condition readings comprising:

a) time keeping means for measuring actual time;

b) tide condition inputs means for receiving a known tide height input corresponding to a known time, and for receiving a selected time input when a prediction of a tide height is desired;

c) tide prediction means for receiving the tide known tide height input, the known time and the actual time, and for determining a predicted tide height reading and a predicted tide direction reading corresponding to the selected time input; and d) display means for displaying the predicted tide height reading and the predicted tide direction reading.

17. Tide prediction device as claimed in claim 16, wherein said display means is a liquid crystal display (LCD).

18. Tide prediction device as claimed in claim 16 wherein said selected time input is an actual time signal from the time keeping means and said prediction of tide height corresponds to said actual time signal; and said display means also displays the actual time.

19. Tide prediction device as claimed in claim 16, wherein said device is a programmable wristwatch to display present or future tide height readings.

20. Tide prediction device for receiving previously measured tide condition inputs and producing predicted tide condition readings comprising:

a) time keeping means for keeping actual time;

b) tide condition inputs means for receiving a known tide height input corresponding to a known time input, and for receiving a selected time input when a prediction of a tide height is desired;

c) tide prediction means for receiving the tide known tide height input, the known time and the actual time, and for determining a predicted tide height reading, a tide direction reading and a moon phase reading corresponding to the selected time input; and d) display means for displaying the predicted tide height reading, the tide direction reading, and the moon phase reading.

21. Tide prediction device as claimed in claim 20, wherein said display means has indicator lights to display the respective reading.

22. Tide prediction device as claimed in claim 20, wherein said display means is a liquid crystal display (LCD).

23. Tide prediction device as claimed in claim 20 wherein said selected time input is an actual time signal from the time keeping means and said prediction of tide height corresponds to said actual time signal; and said display means also displays the actual time.

24. Tide prediction device as claimed in claim 20, wherein said device is a programmable wristwatch to display present or future tide height readings.

25. Tide prediction device for receiving previously measured tide condition inputs and displaying predicted tide condition readings comprising:

a) time keeping means for measuring actual time;

b) tide condition input means for receiving a known tide height input corresponding to a known time input, and for receiving a selected time input when a prediction of a tide height is desired;

c) tide prediction means for receiving the known tide height input, the known time and the actual time, and for determining a predicted tide height reading, a tide direction reading, a moon phase reading and current velocity reading corresponding to the selected time input; and d) display means for displaying the predicted tide height reading, the tide direction reading, the moon phase reading, and the current velocity reading.

26. Tide prediction device as claimed in claim 25, wherein said display means has indicator lights to display the respective reading.

27. Tide prediction device as claimed in claim 25, wherein said display means is a liquid crystal display (LCD).

28. Tide prediction device as claimed in claim 25, wherein said selected time input is an actual time signal from the time keeping means and said prediction of tide height corresponds to said actual time signal; and said display means also displays the actual time.

29. Tide prediction device as claimed in claim 25, wherein said device is a programmable wristwatch to display present or future tide height readings.

* * * * *